United States Patent [19]

Yoshitomi et al.

[11] Patent Number: 4,960,668

[45] Date of Patent: Oct. 2, 1990

[54] MAGNETIC TONER FOR ELECTROPHOTOGRAPHY

[75] Inventors: Toshihiko Yoshitomi, Yokohama; Heihachi Yushina, Machida; Hiromi Horiuchi, Tokyo; Yukio Yamaguchi, Kawasaki; Yasuo Kamoshita, Yokohama; Kiyoshi Sekihara, Tsukui, all of Japan

[73] Assignee: Mitsubishi Kasei Corporation, Tokyo, Japan

[21] Appl. No.: 449,283

[22] Filed: Dec. 5, 1989

Related U.S. Application Data

[63] Continuation of Ser. No. 51,924, May 19, 1987, abandoned.

[30] Foreign Application Priority Data

May 22, 1986 [JP] Japan ..... 61-117966

[51] Int. Cl.[5] ..... G03G 13/09

[52] U.S. Cl. ..... 430/122; 430/106.6; 430/903; 430/110

[58] Field of Search ..... 430/106.6, 122, 903, 430/110

[56] References Cited

U.S. PATENT DOCUMENTS

| | | | |
|---|---|---|---|
| 2,727,826 | 12/1955 | Greig | 106/289 |
| 2,890,968 | 6/1959 | Giaimo et al. | 430/110 |
| 4,108,786 | 8/1978 | Takayama | 430/903 X |
| 4,230,787 | 10/1980 | Watanabe et al. | 430/106.6 |

FOREIGN PATENT DOCUMENTS

| | | |
|---|---|---|
| 50-011240 | 2/1975 | Japan . |
| 51-068235 | 6/1976 | Japan . |
| 51-068834 | 6/1976 | Japan . |
| 51-137421 | 11/1976 | Japan . |
| 52-50240 | 4/1977 | Japan . |

*Primary Examiner*—J. David Welsh

*Attorney, Agent, or Firm*—David G. Conlin; Ernest V. Linek

[57] ABSTRACT

An insulative magnetic toner disclosed herein comprises a magnetic powder, a negative charge control agent, a binder resin and a compound having phenazine ring amorphous-silicon photoreceptor.

The magnetic toner according to the invention is effective for preventing the occurrence of picture image blurring under high humidity when used in an amorphous-silicon photoreceptor.

20 Claims, No Drawings

MAGNETIC TONER FOR ELECTROPHOTOGRAPHY

This is a continuation of copending application(s) Ser. No. 051,924 filed on May 19, 1987, now abandoned.

FIELD OF THE INVENTION

The invention relates to a magnetic toner to be used for the development of an electrostatic charge image formed in electrophotography. More particularly, the invention relates to a magnetic toner which is effective in preventing picture image blurring from occurring under high humidity when used in an amorphous silicon photoreceptor.

PRIOR ART

As one of the conventional methods for developing electrostatic charge images, the one-component developing method using the so-called magnetic toner which contains a magnetic fine powder dispersed in a binder resin is well known. This one-component developing method has many advantages as compared with the known two-component developing methods. For example, it has no need of adjusting the toner concentration due to there being no necessity of using any special carrier and it can use availably compact developing systems. Therefore, the one-component developing method has been well received and widely employed.

Magnetic toner can be generally classified into two types, i.e., the conductive type and the insulative type. In the case of a conductive magnetic toner, the toner is prepared so as to have an electric charge of a polarity opposite that of the electrostatic charge image and as a result an electrostatic image can be developed. In a successive transferring step, the transfer paper is charged by corona discharge or the like so as to have a polarity opposite that of the toner, and as a result the developed image can be transferred to the transfer paper. In this transferring step, the electric charge may penetrate through the transfer paper and hence the polarity of the toner may be changed, causing a lowering of the transfer efficiency. Similarly, the picture image tends to be obtained with signs of blur, stain and unevenness. While, in the case of an insulative magnetic toner having volume resistivity of $10^8$ Ω. cm or more, there is no problem such as in the conductive magnetic toner and the picture image of fine qualities can be obtained on plain paper.

An electrophotographic photoreceptors for a one-component development and transfer type copying system using a magnetic toner, photoreceptors coated with a dispersion of a fine powder such as CdS or ZnO in organic medium, Se photoreceptor applied the dispersion containing As or Te, formed by vapor-deposition, and organic photoconductors formed of polyvinyl carbozole or trinitrofluorene have been employed.

Recently, the semiconductor properties, particularly the photoconductivity, of hydrogenated amorphous silicon (hereinafter referred to as "a-Si") have been investigated and the use of an a-Si as the electrophotographic photoreceptor in addition to solar batteries, photosensors and camera tubes has been studied. Although a-Si is usually prepared in a thin film by the plasma CVD method using silane gas ($Si_nH_{2n+2}$) as a feed gas, the other processes have been proposed for preparing a-Si which has the properties required use as a photoreceptor for various applications, such as charged voltage, spectral sensitivity and resistance to repeated copying. For example, diborane, ammonia, oxygen, hydrocarbons, germane ($Ge_nH_{2n+2}$), silane fluoride or the like, may be incorporated in the feed gas. Alternatively, multiple layers are deposited on a metallic substrate. See U.S. Pat. Nos. 4,225,222, 4,265,991, 4,451,547, 4,507,375, 4,471,042 and so on.

The a-Si photoreceptor has improved properties when compared with the conventional photoreceptors since (1) it is thermally stable (its crystallization temperature is over 400° C. while a conventional Se photoreceptor has a crystallization temperature of 60° C.);

(2) it has a high and almost constant photosensitivity over visible light wavelength range;

(3) it has a high surface hardness (Vickers hardness of over 1500) and shows high resistance to damage such as scratches;

and therefore is employed in various applications such as plain paper copier, laser printer, facsimile and etc.

However, it has been found that the a-Si photoreceptor has one problem which is not so important in with conventional photoreceptors. That is, the a-Si photoreceptor lacks stability under various enviornmental conditions, especially under high humidity. When electrophotography was performed using an a-Si photoreceptor under 70% relative humidity, the picture image obtained was not clear and had blurred outlines. When electrophotography was performed under higher humidity, no picture image was obtained. These phenomena are collectively referred to as "picture image blurring" herein.

Although the causes of picture image blurring are not completerly understood, it has been confirmed that picture image blurring becomes more remarkable as copying operations are repeated. If the photoreceptor is subjected to several thousands copying cycles (charging-exposure-development-transfer) using a conventional plain paper copier under high humidity, the picture image blurring occurs. It has been also confirmed that the a-Si photoreceptor gives clear picture image if humidity is lowered even if the picture image blurring occurred under high humidity. For preventing picture image blurring, therefore, a method of controlling the relative humidity near the surface of the photoreceptor drum constantly below 50% by always heating the a-Si photoreceptor drum at 40° to 50° C. is proposed. However, this method is not satisfactory since it requires the placement of a heater and a temperature regulating means in the photoreceptor drum, thereby increasing the cost of the copying machine and complicating the mechanism of the copying machine.

BACKGROUND OF THE INVENTION

From the results of the experiments carried out for clarifying the causes of picture image blurring, the present inventors made the following discoveries:

(1) Although the phenomenon becomes more remarkable as the copying operation is repeated as described above, this direct cause is to subject the surface of the photoreceptor to degeneration by corona discharge. This fact has been confirmed from the following experiments.

A commerically available copying machine was modified so as to be subjected to only (a) the cycle of initial corona charge and alternating current corona discharge; (b) the cycle of light irradiation; (c) the cycle of magnetic blush development; or (d) the cycle of cleaning, and was repeatedly subjected to each cycle under normal conditions until 10000 copies were obtained. Thereafter, the copying machine was operated under the conditions of 30° C. and 85% relative humidity (RH). The resultant copies were evaluated with respect to picture image blurring. As the result, it was found that the picture image blurring occurred only when a-Si photoreceptor was repeatedly subjected to corona discharge.

For comparison, a commercially available Se photoreceptor was repeatedly subjected to corona discharge. Under the same conditions as above, picture image blurring occurred.

From these facts, it is supposed that in the case of a conventional Se photoreceptor, its surface layer is gradually scraped so as to always keep a fresh surface via the serial copying cycles, particularly development and cleaning cycles due to the relatively low surface hardness, even if picture image blurring occurred by corona discharging and that in the case of an a-Si photoreceptor, its surface layer, degenerated by corona discharging, cannot be removed via the developing and/or cleaning cycles due to its very high surface hardness and therefore the degenerated layer accumulates as copying operations are repeated.

(2) Using the a-Si photoreceptor on which picture image blurring occurred under the conditions of 30° C. and 85% RH, after copying operations were repeated under normal temperature and humidity conditions, until 10000 copies were obtained, the following experiments were carried out.

By washing the photoreceptor with trichloroethylene or forcedly filming with fresh toner on the surface of the photoreceptor, the occurrence of picture image blurring could be prevented.

From the result, it is found that picture image blurring is caused by the degeneration of the filmy toner and that picture image blurring cannot occur either by removing the degenerated toner or by filming with a fresh toner.

From the above findings, it is believed that the filmy toner serves as a layer for protecting the a-Si photoreceptor from corona charging and that the filmy toner is necessarily refreshed for preventing picture image blurring. Therefore, the preferable toner should have a high corona resistance and be easily made to be filmy.

SUMMARY OF THE INVENTION

An object of the invention is to provide a new electrophotographic method using a-Si photoreceptor in which picture image blurring does not occur even under high humidity.

Another object of the invention is to provide a new magnetic toner to be used in the above electrophotographic method.

Another object of the invention is to provide a magnetic toner having a high corona resistance and which can easily made to be filmy.

Other objects and advantages of the invention will become apparent from the following description.

These objects can be attained by an insulative magnetic toner used in an a-Si photoreceptor according to the present invention.

The insulative magnetic toner according to the present invention comprises at least a magnetic powder and a negative charge control agent dispersed in a binder resin and further comprises a compound having a phenazine ring as an additive which is known as a positive charge control agent added to a positive polarity toner. See U.S. Pat. No. 2,727,826, Japanese Patent Application Laying Open Nos. 57-70539, 57-70540, 59-9670, 57-89767, 59-232360, 60-32061 and so on.

DETAILED EXPLANATION OF THE INVENTION

As the binder resin in the magnetic toner of the present invention, various resins known as the binder resin for toner, such as styrene resins, epoxy resins, polyester resins, polyethylene resins can be used. Preferably, the resin having a weight-average molecular weight of from 1000 to 300,000, preferably from 2000 to 300,000 is used. Particularly, polyester resins are preferable. The polyester resin preferably used comprises as an acid component an aromatic polycarboxylic acid such as phthalic acid, terephthalic acid, isophthalic acid or trimellitic acid or an alipthatic polycarboxylic acid such as succinic acid, fumaric acid, adipic acid or sebacic acid and as an alcohol component an aliphatic polyol such as ethylene glycol, diethylene glycol, propylene glycol, 1,2-propylene glycol or 1,4-cyclohexane diol or an ethylene oxide or propylene oxide adduct of bisphenol A.

As the magnetic powder in the magnetic toner of the present invention, various magnetic powders known to be used in magnetic toner can be used. A metal such as iron, manganese, nickel, cobalt or chormium, an oxide or alloy of the above-mentioned metals such as ferrite represented by MO. $Fe_2O_3$ ($M=Mn^{2+}$, $Ni^{2+}$, $Cu^{2+}$, $Mg^{2+}$ or $Zn^{2+}$) or magnetite ($Fe_3O_4$) or a ferromagnetic alloy such as aluminium-manganese alloy or a mixture thereof in a form of finely divided powder can be used. Examples of commercially available magnetites include MTA-740, EPT-1000, EPT-500 (registrated trade marks) which are produced by TODA KOGYO Corp.; RB-BL, BL-200, BL-250 (registered trade marks) which are produced TITANIUM KOGYL K.K.) and the like. The magnetic powder having a particle size of 0.1 to 3 micrometers is preferably used.

The content of the magnetic powder in the magnetic toner of the invention is generally from 25 to 60% by weight, preferably 30 to 55% by weight. If a mixture of the magnetic toners is used, the content of the magnetic powder in each magnetic toner is not necessarily the same.

As a negative charge control agent in the magnetic toner of the present invention, various substances known as negative charge control agents, such as chlorinated polyolefin, chlorinated polyester, a metal salt of a fatty acid or an azo dye complexted with a transition metal such as chromium, iron or cobalt can be used. Examples of commercially available negative charge control agents include BONTRON S-31, S-34, E-82 (registered trade marks) which are produced by ORIENT CHEMICAL INDUSTRIES, LTD. and the like.

The content of the negative charge control agent in the magnetic toner of the present invention is generally from 0.1 to 10% by weight, preferably from 0.5 to 7% by weight.

As the essential additive in the magnetic toner of the present invention, a compound having a phenazine ring such as nigrosine dyes, aniline black dyes, safranine dyes or induline dyes or their modifications with oleic acid, rosin or the like can be used. The nigrosine dye is preferably used. Examples of the commercially available nigrosine dyes include BONTRON N-01, N-03, N-04, N-07, N-09 (registered trade marks) which are produced by ORIENT CHEMICAL INDUSTRIES, LTD. and the like.

The compound having a phenazine ring is internally and/or externally added to the magnetic toner of the invention (the terms "internally addition" and "externally addition" are explained hereinafter). The content of the compound having a phenazine ring is varied depending on whether the compound is internally or externally added. When the compound is internally added, its content is generally from 0.05 to 30% by weight, preferably from 0.1 to 20% by weight, more preferably from 0.2 to 5% by weight based on the weight of the binder resin. When the compound is externally added, its content is generally from 0.01 to 20% by weight, preferably from 0.05 to 5% by weight, more preferably from 0.1 to 2.0% by weight based on the weight of the magnetic toner.

As the other additives optionally used in the magnetic toner, an olefinic polymer having a low molecular weight and a finely divided silica powder for improving the fixability and the flowability of the magnetic toner may be mentioned. Alternatively, an electric resistance control agent such as carbon black may be added since it is desirable that the magnetic toner of the present invention have an electric resistance of about $10^8$ Ω.cm or more, preferably about $10^{14}$ Ω.cm or more (the above-mentioned electric resistance value being determined by introducing the toner sample in a cylinder having a diameter of 1.6 cm and made of acrylic resin in a height of 0.5 cm, applying a load of 2740 g thereto followed by applying direct voltage of 10,000 V/cm to electrodes above and below the cylinder). Examples of other additives include pigments and the like. These additives may be also internally and/or externally added.

The magnetic toner of the present invention can be prepared in accordance with any of the known methods such as a kneading method, a spray-drying method or a microcapsulating method. The kneading method is most standard. In the kneading method, the binder resin, the magnetic powder and the negative charge control agent are mixed in a suitable kneader and the resultant mixture is cooled to be solidified and pulverized followed by classifying so as to obtain toner particles having an particle size of about 10 micrometers in which the magnetic powder and the negative charge control agent are dispersed in the binder resin. The compound having a phenazine ring and optionally the other additives may be added at this stage. Then, any other additives are added to the resultant toner particles and homogeneously mixed in a suitable mixer so as to obtain the magnetic toner. It is possible to add the compound having a phenazine ring at this latter stage. "Internally addition" means to add at the former stage. "Externally addition" means to add at the latter stage. The compound having a phenazine ring and optionally the other additives may be added internally and/or externally.

The thus-prepared magnetic toner of the present invention has preferably an average particle size of from 5 to 20 micrometers for obtaining the optimum resolving power.

The invention now being generally described, will be better understood by reference to certain specific examples which are included herein for purposes of illustration only and are not intended to be limiting of the invention.

COMPARATIVE EXAMPLE

Thirty-six parts by weight of the magnetic powder (magnetite "EPT-1000" (registered trade mark); produced by TODA KOGYO Corp.), 61 parts by weight of the binder resin (polyester resin "LUNAPAIL 1400" (registered trade mark); produced by ARAKAWA CHEMICAL INDUSTRIES, LTD.), 1.2 part by weight of the negative charge control agent (chromium-containing azo dye "S-31" (registered trade mark); produced by ORIENT CHEMICAL INDUSTRIES, LTD.) and 1.8 part by weight of the additive (polypropylene "550P" (registered trade mark); produced by SANYO CHEMICAL INDUSTRIES, LTD.) were mixed. Then, the mixture was melt-kneaded in an extrusion kneader, cooled to be solidified. The solidified mixture was roughly pulverized with a hammer mill and then finely pulverized with a jet mill followed by classifying through a zigzag classifier to obtain the magnetic toner A having an average particle size of 12.2 micrometers.

The thus-obtained toner particles were mixed with 0.5 % by weight of a finely divided silica powder ("R-972" (registered trade mark); produced by NIPPON AEROGIL K.K.) for improving the flowability of the magnetic toner in the super mixer to obtain a toner sample A.

EXAMPLE 1

The procedure in the Comparative Example was repeated to obtain magnetic toner B having an average particle size of 10.8 micometers, provided that 2.0 parts by weight of the compound having a phenazine ring (modified nigrosine dye "BONTRON N-04" (registered trade mark); produced by ORIENT CHEMICAL INDUSTRIES, LTD.) was internally added.

In the same manner as described in the Comparative Example, toner sample B was obtained.

EXAMPLES 2 and 3

In these examples, the compound having a phenazine ring were externally added.

The magnetic toner A obtained in comparative Example was mixed with 1 part by weight of the compound having phenazine ring (modified nigrosine dye "BONTRON N-04" (registered trade mark); produced by ORIENT CHEMICAL INDUSTRIES, LTD.) in a super mixer to obtain magnetic toner C having an average particle size of 11.8 micrometers (toner sample C).

The magnetic toner A obtained in the comparative Example was mixed with 1 part by weight of the compound having a phenazine ring (modified nigrosine dye "BONTRON N-03" (registered trade mark); produced by ORIENT CHEMICAL INDUSTRIES, LTD.) in a super mixer to obtain the magnetic toner D having an average particle size of 12.0 micrometers (toner sample D).

EXAMPLE 4

After each toner sample had been repeatedly subjected to copying coperation in a copying machine having the a-Si photoreceptor in which a heating system was not provided, an print image was obtained under the following conditions while supplying the toner:

temperature: 30° C.
relative humidity: 85%
size of copies: A4 (210 mm×296 mm)

The results are as follows.

When the sample A toner (Comparative Example) was used, picture image blurring occurred under high humidity after at most 2,000 copies (A4) were obtained.

When the sample B toner (Example 1) was used, a clear picture image could be obtained after 50,000 copies (A4) were obtained without any picture image blurring under high humidity.

When the samples C and D toner (Examples 2 and 3) were used, a clear picture image could be obtained after 500,000 copies (A4) were obtained without any picture image blurring under high humidity.

EFFECT OF THE INVENTION

The magnetic toner according to the present invention in which a compound having a phenazine ring is internally and/or externally added can prevent the occurrence of picture image blurring in electrophotography using an a-Si photoreceptor.

The occurrence of picture image blurring can be prevented using the magnetic toner of the present invention even if the photoreceptor is not heated, Thereby reducing the cost of the copying machine.

The photoconductivity of the photoreceptor can be maintained almost constantly since it is not necessary to heat the photoreceptor when using the magnetic toner of the present invention and therefore a clear picture image can be obtained.

The constant concentration of the picture image and the improvement of the transfer efficiency (about 10% increase) can be obtained using the magnetic toner of the present invention, thereby the consumption amount of the toner can be reduced as well as the photoreceptor and the copying machine can be remarkably prevented from contamination by the toner.

What is claimed is:

1. A method of developing a latent electrostatic image on an amorphous silicon photoreceptor comprising contacting said photoreceptor with a specific magnetic toner which comprises a magnetic powder, a negative charge control agent, a binder resin and a compound having a phenazine ring.

2. The method according to claim 1, wherein at least the magnetic powder and the negative charge control agent are dispersed in the binder resin.

3. The method according to claim 1, wherein the compound having phenazine ring is internally and/or externally added.

4. The method according to claim 3, wherein the compound having a phenazine ring is externally added in an amount of from about 0.01% to 20% by weight based on the weight of the toner.

5. The method according to claim 4, wherein the amount of the compound having a phenazine ring is from about 0.05% to 5% by weight based on the weight of the toner.

6. The method according to claim 5, wherein the amount of the compound having a phenazine ring is from about 0.1% to 2.0% by weight based on the weight of the toner.

7. The method according to claim 3, wherein the compound having a phenazine ring is internally added in an amount of from about 0.05% to 30% by weight based on the weight of the binder resin.

8. Ther method according to claim 7, wherein the amount of the compound having a phenazine ring is from about 0.1% to 20% by weight based on the weight of the binder resin.

9. The method according to claim 8, wherein the amount of the compound having a phenazine ring is from about 0.2% to 5% by weight based on the weight of the binder resin.

10. The method according to claim 1, wherein the compound having a phenazine ring is a nigrosine dye, optionally modified with oleic acid or rosin.

11. The method according to claim 1, wherein the content of the magnetic powder is from about 25% to 60% by weight.

12. The method according to claim 11, wherein the content of the magnetic powder is from about 30% to 55% by weight.

13. The method according to claim 1, wherein the magnetic powder is a magnetite.

14. The method according to claim 1, wherein the content of the negative charge control agent is from about 0.1% to 10% by weight.

15. The method according to claim 14, wherein the content of the negative charge control agent is from about 0.5% to 7% by weight.

16. The method according to claim 1, wherein the negative charge control agent is an azo dye containing a transition metal.

17. The method according to claim 1, wherein the binder resin is a polyester resin.

18. The method according to claim 1, wherein the toner further contains one or more additives selected from the group consisting of a low molecular weight olefinic polymer, a finely divided silica powder, an electric resistance control agent and a pigment.

19. The method according to claim 1, wherein the insulative magnetic toner is the toner in which from about 25% to 60% by weight of a magnetite and from about 0.1% to 10% by weight of a chromium-containing azo dye are dispersed in a polyester resin and in which from about 0.01% to 20% by weight of a nigrosine dye, which may be modified, is externally added.

20. The method according to claim 19, wherein the toner further contains a polypropylene.

* * * * *